US010369784B2

(12) United States Patent
Kayahara et al.

(10) Patent No.: US 10,369,784 B2
(45) Date of Patent: Aug. 6, 2019

(54) PRINTING APPARATUS AND PRINTING METHOD

(71) Applicant: SEIKO EPSON CORPORATION, Tokyo (JP)

(72) Inventors: Naoki Kayahara, Nagano (JP); Tatsuya Nakano, Nagano (JP); Eishin Yoshikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/949,347

(22) Filed: Apr. 10, 2018

(65) Prior Publication Data

US 2018/0304625 A1 Oct. 25, 2018

(30) Foreign Application Priority Data

Apr. 21, 2017 (JP) ..... 2017-084208

(51) Int. Cl.
*B41J 2/045* (2006.01)
*B41J 2/21* (2006.01)
*B41J 2/145* (2006.01)

(52) U.S. Cl.
CPC ..... *B41J 2/04543* (2013.01); *B41J 2/04581* (2013.01); *B41J 2/145* (2013.01); *B41J 2/2114* (2013.01)

(58) Field of Classification Search
CPC .... B41J 2/04543; B41J 2/04581; B41J 2/145; B41J 2/2114; B41J 2/211; B41J 11/0015
See application file for complete search history.

(56) References Cited

U.S. PATENT DOCUMENTS

2002/0191046 A1 12/2002 Otsuki
2002/0196303 A1 12/2002 Koitabashi et al.
2006/0158494 A1* 7/2006 Yamanobe ..... B41J 2/2114 347/96
2008/0074455 A1 3/2008 Yoshida et al.
(Continued)

FOREIGN PATENT DOCUMENTS

JP 2000-190480 A 7/2000
JP 2006-218860 A 8/2006
(Continued)

OTHER PUBLICATIONS

The Extended European Search Report for the corresponding European Patent Application No. 18168139.6 dated Sep. 21, 2018.

*Primary Examiner* — Julian D Huffman
*Assistant Examiner* — Michael T Konczal

(57) ABSTRACT

There is provided a printing apparatus including a print head that has a color nozzle row for applying ink to a roll paper and a working liquid nozzle row, a main scanning unit that relatively moves the print head with respect to the roll paper in the main scanning direction (X-axis direction), a sub-scanning unit that relatively moves the roll paper in the sub-scanning direction (Y-axis direction) intersecting the main scanning direction (X-axis direction) with respect to the print head, and a control device that controls a relative position between a use area of the nozzle included in the color nozzle row in the sub-scanning direction (Y-axis direction) and a use area of the nozzle included in a working liquid nozzle row, based on the attribute information of the roll paper.

9 Claims, 11 Drawing Sheets

(56) References Cited

U.S. PATENT DOCUMENTS

| | | | | |
|---|---|---|---|---|
| 2012/0050362 | A1* | 3/2012 | Iritani | B41J 2/2114 347/9 |
| 2012/0081461 | A1 | 4/2012 | Kakutani | |
| 2013/0300785 | A1* | 11/2013 | Tsuchiya | B41J 2/21 347/7 |
| 2014/0253621 | A1* | 9/2014 | Sakurada | B41J 2/2132 347/15 |
| 2017/0072707 | A1 | 3/2017 | Kamibayashi et al. | |

FOREIGN PATENT DOCUMENTS

| | | | |
|---|---|---|---|
| JP | 2010-201711 | A | 9/2010 |
| JP | 2013-151080 | A | 8/2013 |
| JP | 2015-189110 | A | 11/2015 |
| JP | 2017-056589 | A | 3/2017 |

* cited by examiner

PRINTING APPARATUS AND PRINTING METHOD

BACKGROUND

1. Technical Field

The present invention relates to a printing apparatus provided with a serial head for applying a liquid and a printing method using the printing apparatus.

2. Related Art

In the related art, for example, in printing on various print media like an ink printing method (printing method) and an ink printing apparatus (printing apparatus) described in JP-A-2000-190480, a method of performing printing by using a processing liquid for the purpose of improving print quality such as optical density (optical concentration) (OD) and high-speed fixing is known. In the example described in JP-A-2000-190480, a processing liquid for promoting solidification of ink and coloring material in the ink is used and a plurality of print modes including a print mode in which a processing liquid that promotes solidification is applied to a print medium and a mode in which ink is applied to the print medium without using the processing liquid are prepared, and one mode according to mode setting information is selected from the plurality of print modes according to a type of the print medium.

However, the printing method described in JP-A-2000-190480 merely selects whether or not to use the processing liquid depending on the type of a print medium, and there is room for improvement in order to apply more optimum printing to diversified print media, such as changing specifications (amount of use, timing of use, and the like) using the processing liquid depending on the type of print medium.

SUMMARY

The invention can be realized in the following aspects or application examples.

Application Example 1

According to this application example, there is provided a printing apparatus including a print head that has a first nozzle group and a second nozzle group for applying a liquid to a print medium, a main scanning unit that relatively moves the print head respect to the print medium in a main scanning direction with, a sub-scanning unit that relatively moves the print medium with respect to the print head in a sub-scanning direction intersecting the main scanning direction, and a control unit that performs control a relative position between a use area of nozzles included in the first nozzle group and a use area of nozzles included in the second nozzle group in the sub-scanning direction, based on attribute information of the print medium.

According to the application example, it is possible to perform control of the timing at which a liquid is applied by the nozzles included in the second nozzle group to the timing at which the liquid is applied by the nozzles included in the first nozzle group based on the attribute information of the print medium.

Application Example 2

In the printing apparatus according to the application example, the attribute information includes a medium name of the print medium.

According to the application example, it is possible to perform control of the timing at which the liquid is applied the liquid by the nozzles included in the second nozzle group to the timing at which the liquid is applied by the nozzles included in the first nozzle group is performed based on the medium name of the print medium. As a result, it is possible to suppress a difference (decline) in print quality for each combination of a liquid and a print medium.

Application Example 3

In the printing apparatus according to the application example, in a pass operation of applying the liquid to the print medium while relatively moving the print head with respect to the print medium in the main scanning direction, the control unit perform controls, according to the medium name, in either one of a first mode in which the use area of the nozzles included in the first nozzle group and the use area of the nozzles included in the second nozzle group are used in different pass operations and a second mode in which the use area of the nozzles included in the first nozzle group and the use area of the nozzles included in the second nozzle group are used in the same pass operation.

According to the application example, it is possible to perform control of a relative position of the use area of an appropriate nozzle by selecting the medium name of the print medium. As a result, it is possible to suppress a difference (reduction) in print quality for each combination of liquid and the print medium.

Application Example 4

In the printing apparatus according to the application example, the attribute information includes information on a permeation speed at which the liquid permeates the print medium.

According to this application example, it is possible to perform control of the timing of applying the liquid by the nozzles included in the second nozzle group to the timing of applying the liquid by the nozzles included in the first nozzle group based on the permeation speed at which the liquid permeates the print medium. As a result, it is possible to suppress the difference (reduction) in print quality due to a difference in the permeation speed of liquid.

Application Example 5

In the printing apparatus according to the application example, the control unit performs control of the relative position with respect to a second print medium having the permeation speed higher than that of a first print medium so that a time difference between a timing at which the liquid is applied by the nozzles included in the first nozzle group and a timing at which the liquid is applied by the nozzles included in the second nozzle group is smaller than the time difference with respect to the first print medium.

According to the application example, the control unit performs control of the relative position (relative position between the use area of the nozzle included in the first nozzle group and the use area of the nozzle included in the second nozzle group in the sub-scanning direction) with respect to the print medium having a higher permeation speed so that the time difference between the timing at which the liquid is applied by the nozzles included in the first nozzle group and the timing at which the second nozzle group and the timing at which the liquid is applied by the nozzles included in the second nozzle group becomes smaller. For that reason, it is possible to suppress the difference (reduction) in print quality due to the difference in the permeation speed of the liquid.

Application Example 6

In the printing apparatus according to the application example, in a pass operation in which the liquid is applied to the print medium while relatively moving the print head with respect to the print medium in the main scanning direction, the control unit performs control of the relative position so that the use area of the nozzle included in the first nozzle group and the use area of the nozzle included in the second nozzle group become areas used in the different pass operation with respect to the print medium having a permeation speed lower than a predetermined value and the use area of the nozzle included in the first nozzle group and the use area of the nozzle included in the second nozzle group become areas used in the same pass operation with respect to the print medium having the permeation speed equal to or greater than the predetermined value.

According to the application example, with respect to the print medium having the permeation speed lower than a predetermined value, application of a liquid by the nozzles included in the first nozzle group and application of liquid by the nozzles included in the second nozzle group are performed in the different pass operation and with respect to the print medium having the permeation speed equal to or greater than the predetermined value, application of liquid by the nozzles included in the first nozzle group and application of liquid by the nozzles included in the second nozzle group are performed in the same pass operation. For that reason, it is possible to suppress the difference (reduction) in print quality due to the difference in the permeation speed of the liquid.

Application Example 7

In the printing apparatus according to the application example, the control unit may make an application amount of the liquid to be applied first, among the liquid to be applied from the nozzles included in the first nozzle group and the liquid to be applied from the nozzles included in the second nozzle group, with respect to a second print medium having the permeation speed higher than that of the first print medium larger than the application amount with respect to the first print medium.

According to the application example, control is performed in such a way that the application amount of the liquid to be applied first, among the liquid to be applied from the nozzles included in the first nozzle group and the liquid to be applied from the nozzles included in the second nozzle group, is made larger with respect to the print medium having a higher permeation speed. For that reason, it is possible to suppress the difference (reduction) in print quality due to the difference in the permeation speed of the liquid.

Application Example 8

In the printing apparatus according to the application example, the second nozzle group includes an A nozzle group capable of applying the liquid to the same area in the pass operation which is the same as that of the first nozzle group and a B nozzle group capable of applying the liquid to different areas in the pass operation which is the same as that of the first nozzle group, in a pass operation of applying the liquid to the print medium while relatively moving with respect to the print medium in the main scanning direction, and the control unit generates halftone data which is for determining a formation state of dots to be formed, with respect to the same area of the image data, by applying the liquid in each of the A nozzle group and the B nozzle group, in generating print data which is for performing control the relative position and is for executing printing based on image data, selects one of the generated halftone data based on the attribute information of the print medium, and generates the print data.

According to the application example, it is possible to select any one of an area (A nozzle group) of the second nozzle group capable of applying the liquid to the same area in the same pass operation as the first nozzle group from the second nozzle group and another area (B nozzle group) of the second nozzle group capable of applying the liquid to different areas in the same pass operation as the first nozzle group, based on the attribute information of the print medium. As a result, it is possible to select a printing method having a more appropriate time difference by being correlated with the attribute information of the print medium, in the time difference between the timing of applying the liquid by the nozzles included in the first nozzle group and the timing of applying the liquid by the nozzles included in the second nozzle group.

Application Example 9

According to this application example, there is provided a printing method which is performed in a printing apparatus including a print head that has a first nozzle group and a second nozzle group for applying a liquid to a print medium, a main scanning unit that relatively moves the print head with respect to the print medium in a main scanning direction, and a sub-scanning unit that relatively moves the print medium in a sub-scanning direction intersecting the main scanning direction with respect to the print head, and which includes performing control of a relative position between a use area of nozzles included in the first nozzle group and a use area of the nozzles included in the second nozzle group in the sub-scanning direction, based on attribute information of the print medium.

According to the application example, it is possible to perform control of the timing at which the liquid is applied by the nozzles included in the second nozzle group to the timing at which the liquid is applied by the nozzles included in the first nozzle group, based on the attribute information of the print medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
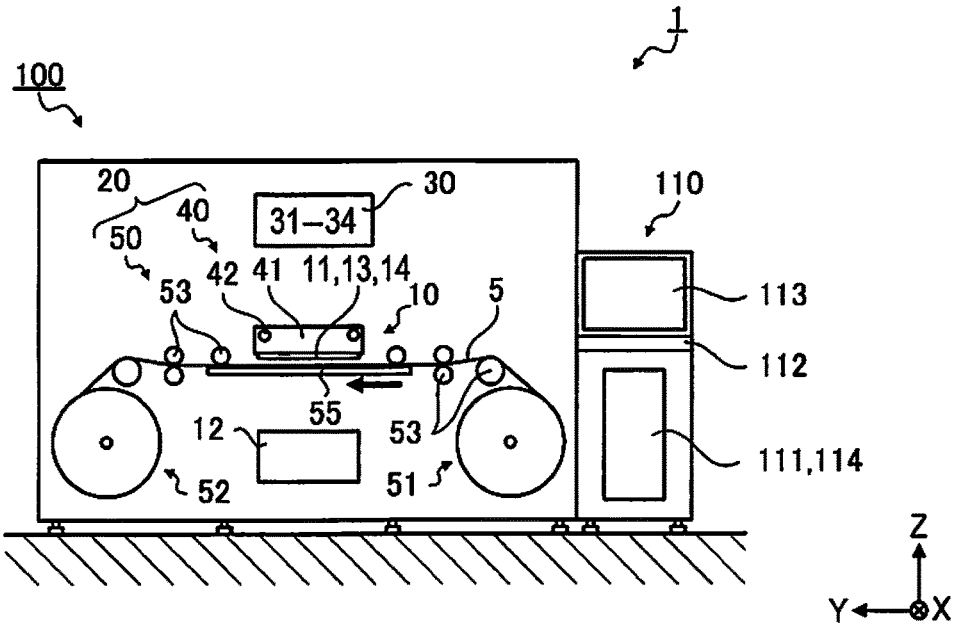
FIG. 1 is a front view illustrating a configuration of a printing system as a printing apparatus according to Embodiment 1.

Hereinafter, embodiments embodying the invention will be described with reference to the drawings. The following is one embodiment of the invention and is not intended to limit the invention. In the following respective drawings, in order to make explanation easier to understand, description may be made in a scale different from an actual scale. In addition, in the coordinates attached to the drawing, the Z-axis direction is the up-and-down direction, the +Z direction is the up direction, the X-axis direction is the front-and-rear direction, the −X direction is the front direction, the Y-axis direction is the left-and-right direction, the +Y direction is the left direction, and the X-Y plane is a horizontal plane.

Embodiment 1

Figure 2:
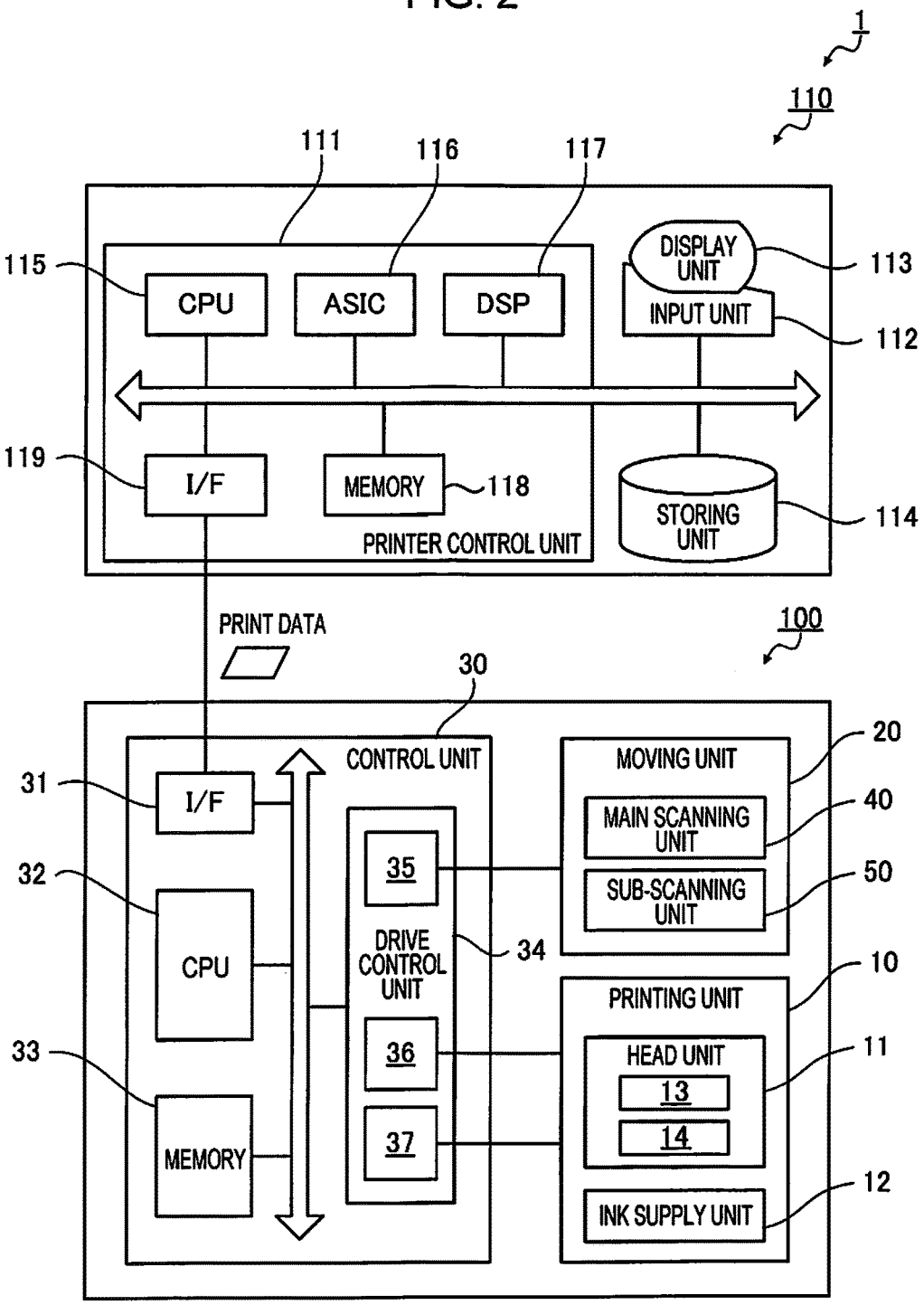
FIG. 2 is a block diagram illustrating a configuration of the printing system as the printing apparatus according to Embodiment 1.

FIG. 1 is a front view illustrating a configuration of a printing system 1 according to Embodiment 1 and FIG. 2 is a block diagram thereof.

The printing system 1 includes a printer 100 and a control device 110 connected to the printer 100.

The printing system 1 is a "printing apparatus" in the invention and the control device 110 is a "control unit" in the invention.

The printer 100 is an ink jet printer which prints a desired image on roll paper 5 as a long "print medium" supplied in a state of being wound in a roll shape, based on print data received from the control device 110.

Basic Configuration of Control Device

The control device 110 includes a printer control unit 111, an input unit 112, a display unit 113, a storing unit 114, and the like, and controls a print job that causes the printer 100 to perform printing. The control device 110 is configured using a personal computer as a preferred example.

Software allows the control device 110 to operate includes general image processing application software (hereinafter, referred to as application) that handles image data to be printed and printer driver software (hereinafter, referred to as printer driver) that performs control of the printer 100 and generates print data for causing the printer 100 to execute printing.

That is, the control device 110 controls the printer 100 via print data for causing the printer 100 to print a print image based on image data.

The printer driver is not limited to an example configured as a functional unit by software, and may be configured with, for example, firmware. The firmware is installed in, for example, the System on Chip (SOC), in the control device 110.

A printer control unit 111 includes a CPU 115, an ASIC 116, a DSP 117, a memory 118, a printer interface unit (I/F) 119, and the like, and centrally manages the entire printing system 1.

The input unit 112 is an information input unit as a human interface. Specifically, for example, the input unit 112 is a port to which a keyboard or an information input device is connected.

A display unit 113 is an information display unit (display) as the human interface and displays information input from the input unit 112, images to be printed on the printer 100, and information relating to a print job, and the like under the control of the printer control unit 111.

The storing unit 114 is a rewritable storage medium such as a hard disk drive (HDD) or a memory card and stores software (program operated by the printer control unit 111) which allows the control device 110 to operate, image to be printed, information relating to the print job.

The memory 118 is a storage medium for securing an area storing a program which allows the CPU 115 to operate, a working area in which the program is operated, and the like, and is configured with a memory element such as a RAM, an EEPROM, and the like.

Basic Configuration of Printer 100

The printer 100 is configured with a printing unit 10, a moving unit 20, a control unit 30, and the like. When print data is received from the control device 110, the printer 100 controls a printing unit 10 and the moving unit 20 by the control unit 30 and prints an image (forms image) on the roll paper 5.

The print data is data for forming image obtained by converting image data so that the image data can be printed by the printer 100 using the application and the printer driver included in the control device 110, and includes a command for controlling the printer 100.

The image data includes, for example, general full-color image information, text information obtained by a digital camera, and the like.

The printing unit 10 is configured with a head unit 11, an ink supply unit 12, and the like.

The moving unit 20 is configured with a main scanning unit 40, a sub-scanning unit 50, and the like. The main scanning unit 40 is configured with a carriage 41, a guide shaft 42, a carriage motor (not illustrated), and the like. The sub-scanning unit 50 is configured with a supply portion 51, a storage portion 52, a transport roller 53, a platen 55, and the like.

A head unit 11 includes a print head 13 having a plurality of nozzles (nozzle groups) for ejecting printing ink (hereinafter, referred to as ink) as a "liquid", as ink droplets, and a head control unit 14. The head unit 11 is mounted on the carriage 41 and reciprocates in the main scanning direction accompanied by the carriage 41 moving in the main scanning direction (X-axis direction in FIG. 1). The head unit 11 (print head 13) ejects ink droplets onto the roll paper 5 supported by the platen 55 under the control of the control unit 30 while moving in the main scanning direction, such that dot rows along the main scanning direction (raster line) is formed on the roll paper 5.

An ink supply unit 12 includes an ink tank and an ink supply path (not illustrated) for supplying ink from the ink tank to the print head 13 and the like. An ink supply passage spanning to the ink tank, the ink supply path, and the nozzles that eject the same ink are independently provided for each ink.

For example, in ink, as a color ink set composed of a dark ink composition, there is an ink set of four colors obtained by adding black (K) to an ink set of three colors of cyan (C), magenta (M), and yellow (Y), and the like. For example, there is a color ink set of eight colors obtained by adding an ink set of light cyan (Lc), light magenta (Lm), light yellow (Ly), light black (Lk), and the like which are made from a light ink composition in which concentration of each color material is lightened, and the like to the ink set of four colors.

In addition to the ink sets for color printing, ink to be used by the printer 100 includes a working liquid (OP) for improving print quality and image quality. As the working liquid (OP), for example, there is a reaction liquid for aggregating coloring materials contained in the ink sets described above to enhance a fixing property of ink, base ink for forming a base white layer (or colored layer) on a transparent print medium, a thixotropic liquid forming a base for suppressing bleeding of color ink, and clear ink for enhancing glossiness or a coloring property of a printed image, and the like.

A piezo method is used for a method (ink jet method) of ejecting ink droplets. In the piezo method, printing is performed in such a way that pressure corresponding to a print information signal is applied to ink stored in a pressure chamber by a piezoelectric element (piezo element) and ink droplets are injected (ejected) from a nozzle communicating with the pressure chamber.

The method of ejecting ink droplets is not limited thereto, and other printing methods of injecting ink in droplet form to form a group of dots on a print medium may be adopted. For example, a method in which ink is continuously injected from a nozzle in a droplet form with a strong electric field between the nozzle and an accelerating electrode placed in front of the nozzle and a printing information signal is given from a deflecting electrode while the ink droplet flies, a method (electrostatic suction method) in which an ink droplet is injected by being associated with the print information signal without deflecting the ink droplet, a method of forcibly injecting ink droplets by applying pressure to ink with a small pump and mechanically vibrating the nozzle with a crystal oscillator or the like, a method (thermal jet method) in which printing in performed in such a way that ink is heated and foamed by a microelectrode according to the print information signal and ink droplets are injected, and the like may be adopted.

The moving unit 20 (main scanning unit 40 and sub-scanning unit 50) relatively moves the roll paper 5 with respect to the head unit 11 (print head 13) under the control of the control unit 30.

The guide shaft 42 extends in the main scanning direction and supports the carriage 41 in a slidable contact state, and the carriage motor serves as a driving source when reciprocating the carriage 41 along the guide shaft 42. That is, the main scanning unit 40 (carriage 41, guide shaft 42, and carriage motor) moves the carriage 41 (that is, print head 13) along the guide shaft 42 in the main scanning direction under the control of the control unit 30.

The supply portion 51 rotatably supports the reel on which the roll paper 5 is wound in a roll form and sends out the roll paper 5 to a transport path. The storage portion 52 rotatably supports the reel for winding up the roll paper 5 and winds up the printing completed roll paper 5 from the transport path.

The transport roller 53 is configured with a driving roller for moving the roll paper 5 in the sub-scanning direction (Y-axis direction illustrated in FIG. 1) intersecting the main scanning direction, a driven roller rotating accompanied by movement of the roll paper 5, and the like, and configures a transport path for transporting the roll paper 5 from the supply portion 51 to the storage portion 52 via a printing area (area where the print head 13 moves in the main scanning direction on the upper surface of the platen 55) of the printing unit 10.

The control unit 30 includes an interface unit (I/F) 31, a CPU 32, a memory 33, a drive control unit 34, and the like, and controls the printer 100.

The interface unit 31 is connected to a printer interface unit 119 of the control device 110, and performs data transmission and reception between the control device 110 and the printer 100. The control device 110 and the printer 100 may be connected directly with a cable or indirectly via a network or the like. Data may be transmitted and received between the control device 110 and the printer 100 via wireless communication.

The CPU 32 is an operation processing device for controlling the entire printer 100.

The memory 33 is a storage medium for securing an area for storing a program operated by the CPU 32, a working area in which the program is operated, and the like, and is configured with memory elements such as a RAM and an EEPROM.

The CPU 32 controls the printing unit 10 and the moving unit 20 via the drive control unit 34 according to the program stored in the memory 33 and print data received from the control device 110.

The drive control unit 34 controls driving of the printing unit 10 (head unit 11 and ink supply unit 12) and the moving unit 20 (main scanning unit 40 and sub-scanning unit 50) under the control of the CPU 32. The drive control unit 34 includes a movement control signal generation circuit 35, an ejection control signal generation circuit 36, and a drive signal generation circuit 37.

The movement control signal generation circuit 35 is a circuit that generates signals for controlling the moving unit 20 (main scanning unit 40 and sub-scanning unit 50) according to an instruction from the CPU 32.

The ejection control signal generation circuit 36 is a circuit that generates a head control signal for selecting a nozzle to eject ink, for selecting an ejecting amount, controlling the ejection timing, and the like according to an instruction from the CPU 32 based on print data.

The drive signal generation circuit 37 is a circuit that generates a basic drive signal including a drive signal for driving the piezoelectric element of the print head 13.

The drive control unit 34 selectively drives the piezoelectric element corresponding to each of the nozzles based on the head control signal and the basic drive signal.

With the configuration as described above, the control unit 30 forms (prints) a desired image on the roll paper 5 by repeating a pass operation (ejection) of ejecting (applying) ink droplets from the print head 13 while moving the carriage 41 supporting the print head 13 along the guide shaft 42 in the main scanning direction (X axis direction), with respect to the roll paper 5 supplied to the printing area by the sub-scanning unit 50 (supply portion 51 and transport roller 53) and a transport operation (feed operation) for moving the roll paper 5 (sub-scanning) in the sub-scanning direction (Y-axis direction) intersecting the main scanning direction by the sub-scanning unit 50 (transport roller 53).

Basic Function of Printer Driver

Figure 3:
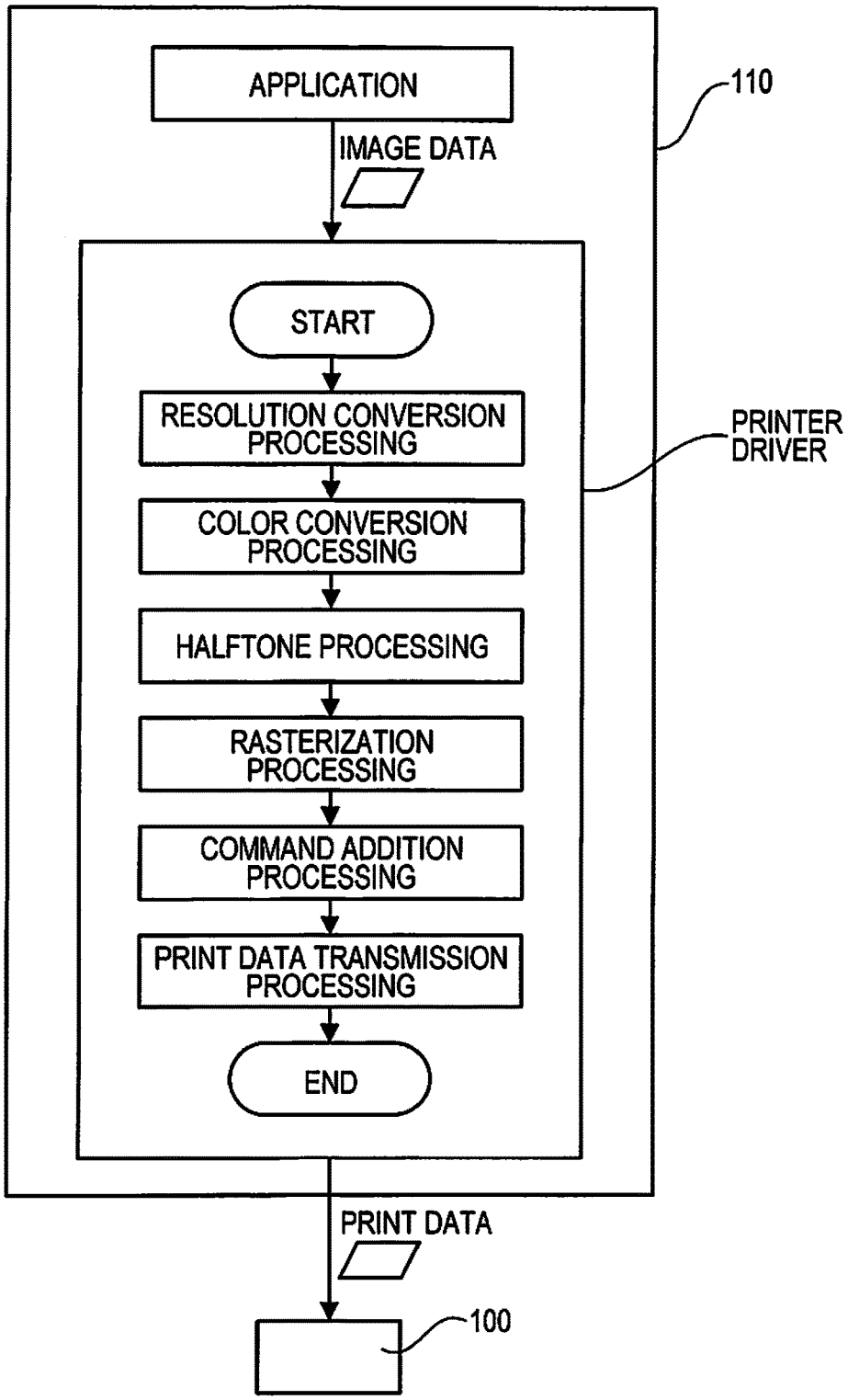
FIG. 3 is an explanatory diagram of basic functions of a printer driver.

FIG. 3 is an explanatory diagram of basic functions of the printer driver.

Printing on the roll paper 5 is started by transmission of print data from the control device 110 to the printer 100. The print data is generated by the printer driver.

Hereinafter, print data generation processing in the related art will be described with reference to FIG. 3.

The printer driver receives image data from an application, converts the image data into print data in a format interpretable by the printer 100, and outputs the print data to the printer 100. When image data from the application is converted into the print data, the printer driver performs resolution conversion processing, color conversion processing, halftone processing, rasterization processing, command addition processing, and the like.

Resolution conversion processing is processing for converting resolution of image data output from the application into resolution (print resolution) at the time of printing on the roll paper 5. For example, when print resolution is specified as 720×720 dpi, image data in a vector format received from the application is converted into image data in a bitmap format having resolution of 720×720 dpi. Each pixel data of the image data after resolution conversion processing is configured with pixels arranged in a matrix shape. Each pixel has, for example, a gradation value of 256 gradations in RGB color space. That is, pixel data after the resolution conversion indicates the gradation value of a corresponding pixel.

Pixel data corresponding to one column of pixels aligned in a predetermined direction among pixels arranged in a matrix shape is called raster data. The predetermined direction in which the pixels corresponding to the raster data are aligned corresponds to a movement direction (main scanning direction) of the print head 13 at the time of printing the image.

Color conversion processing is processing for converting RGB data into data in CMYK color space. The CMYK colors are cyan (C), magenta (M), yellow (Y), and black (K), and image data in CMYK color space is data corresponding to colors of ink of the printer 100. Accordingly, for example, in a case where the printer 100 uses ten kinds of inks of a CMYK color system, the printer driver generates image data of 10-dimensional space of the CMYK color system based on RGB data.

This color conversion processing is performed based on a table (color conversion look-up table (LUT)) in which gradation values of RGB data are associated with the gradation values of CMYK color system data. Pixel data after color conversion processing is CMYK color system data of, for example, 256 gradations represented by the CMYK color system space.

Halftone processing is processing for converting data of a high gradation number (256 gradations) into data of the number of gradations that can be formed by the printer 100. By this halftone processing, data indicating 256 gradations is converted into, for example, halftone data for determining a dot formation state, such as 1-bit data indicating 2 gradations (dot is present or absent), 2-bit data indicating 4 gradations (no dot, small dot, medium dot, large dot). Specifically, a generation rate of dot corresponding to the gradation value (for example, in the case of four gradations, generation rates of no dot, small dot, medium dot, and large dot) is obtained from a dot generation rate table in which a gradation value (0 to 255) corresponding to a dot generation rate and pixel data is created so that dots are formed in a dispersed manner by using a dither method, an error diffusion method, or the like, at the obtained generation rate. As described above, in halftone processing, halftone data for determining the formation state of dots formed by a nozzle group ejecting ink of the same color (or the same kind) is generated.

Rasterization processing is processing for sorting pixel data (for example, 1 bit or 2 bit halftone data as described above) aligned in a matrix shape according to dot formation order at the time of printing. Rasterization processing includes allocation processing for allocating image data, which is configured with pixel data (halftone data) after halftone processing, to each pass operation in which the print head 13 (nozzle row) ejects ink droplets while performing main scanning movement. When allocation processing is completed, pixel data aligned in a matrix shape is allocated to the actual nozzles which form each raster line forming the print image in each pass operation.

Command addition processing is processing for adding command data according to the printing method to data subjected to rasterization processing. Command data includes, for example, transport data relating to transport specification (speed, amount of movement, and the like in the sub-scanning direction (Y-axis direction)) of the print medium (roll paper 5).

These processing by the printer driver are performed by the ASIC 116 and the DSP 117 (see FIG. 2) under the control of the CPU 115, and generated print data is transmitted to the printer 100 via the printer interface unit 119 by print data transmission processing.

Print Head (Related Art)

Figure 4:
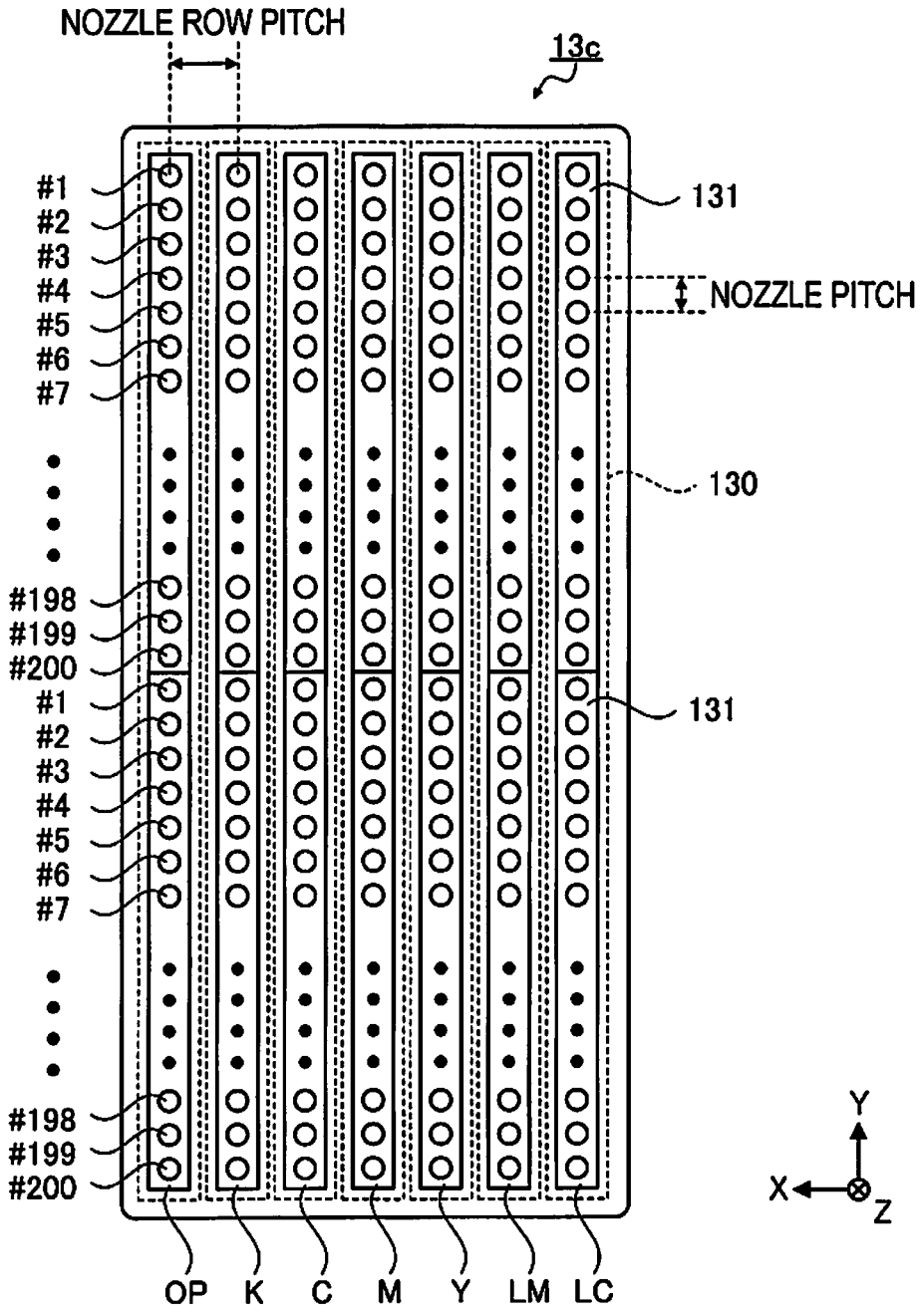
FIG. 4 RELATED ART
FIG. 4 is a schematic view illustrating an example of an arrangement of nozzles in a print head of the related art.

FIG. 4 is a schematic diagram illustrating an example of arrangement of nozzles in a print head of the related art (hereinafter, referred to as a print head 13*c* for distinction from the print head 13 of Embodiment 1). FIG. 4 illustrates a state when viewed from the lower surface of the print head 13*c*.

As illustrated in FIG. 4, the print head 13*c* includes seven nozzle rows 130 (working liquid nozzle row OP, a black ink nozzle row K, a cyan ink nozzle row C, a magenta ink nozzle row M, a yellow ink nozzle row Y, a light magenta ink nozzle row LM, and a light cyan ink nozzle row LC) in which a plurality of nozzles for ejecting each ink are formed side by side at a predetermined nozzle pitch. The nozzle rows 130 are aligned and arranged so as to be parallel in a direction (X-axis direction) intersecting the sub-scanning direction (Y-axis direction) at a constant interval (nozzle row pitch).

The nozzle row 130 is composed of two nozzle chips 131 extending in the Y-axis direction and aligned side by side, and each of the nozzle chips 131 has 200 nozzles of #1 to #200 aligned side by side at a constant interval (nozzle pitch) along the sub-scanning direction (Y-axis direction).

The nozzle chip 131 is manufactured by, for example, a micro electro mechanical systems (MEMS) manufacturing process applying a semiconductor process by using a silicon wafer as a basic material, and the 200 nozzles of the nozzle chip 131 constitute a "nozzle group" having the same or approximate ink ejection characteristics.

That is, the print head 13*c* configuring the "nozzle group" is configured with a plurality of nozzle chips 131 as "nozzle groups".

Each nozzle is provided with a driving element (piezoelectric element such as the piezoelectric element described above) for driving each nozzle to eject an ink droplet.

Problems to be Solved in Related Art

In the configuration of the nozzle row according to such related art, in a case where it is necessary to provide a sufficient time difference between the ejection timing of the working liquid (OP) and the ejection timing of ink other than the working liquid, it is necessary to perform ejection of the working liquid (OP) and ejection of ink other than the working liquid separately in different pass operations without performing the transport operation (feeding operation) for moving the roll paper 5.

In the configuration of the nozzle row according to the related art, for example, a method in which in a case where it is necessary to form a base layer and eject color ink after the base layer has hardened to some extent and fixed, the base layer is formed by the previous pass operation and color ink is ejected in the next pass operation without performing the feeding operation of the roll paper 5, or the like is adopted.

However, in such a method, since the number of pass operations required for printing is doubled, there is a problem to be solved that the printing speed (productivity of printing) is reduced (halved).

On the other hand, depending on the type of the roll paper 5 (print medium) (depending on difference in materials, presence or absence of surface treatment, and the like), there are a case where no time is required for forming the base layer and a case where the effect of the working liquid (OP) decreases when time passes from the application of the working liquid (OP), and there was room for further improvement in order to apply more appropriate printing, such as making it possible to more easily change specifications (timing of use, use amount, and the like) to the diversified print media using the working liquid (OP), depending on the kind of the print medium and the kind of the working liquid (OP).

In contrast, the printing system 1 of Embodiment 1 includes a print head 13 having a first nozzle group and a second nozzle group for applying ink to the roll paper 5, a main scanning unit 40 for relatively moving the print head 13 in the main scanning direction with respect to the roll paper 5, a sub-scanning unit 50 for relatively moving the roll paper 5 in the sub-scanning direction (Y-axis direction) intersecting the main scanning direction with respect to the print head 13, and a control device 110 for controlling the relative position between the use area of the nozzles included in the first nozzle group and the use area of the nozzle included in the second nozzle group in the sub-scanning direction (Y-axis direction), based on attribute information of the roll paper 5.

A printing method of embodiment is a printing method in the printing system 1, which includes a print head 13 having the color nozzle row 201 and the working liquid nozzle row 202 for applying ink to the roll paper 5, the main scanning unit 40 for relatively moving the print head 13 in the main scanning direction (X-axis direction) with respect to the roll paper 5, the sub-scanning unit 50 for relatively moving the roll paper 5 in the sub-scanning direction (Y-axis direction) intersecting the main scanning direction (X-axis direction) with respect to the print head 13, and in the printing method, control of the relative position between the use area of the nozzles included in the color nozzle row 201 and the use area of the nozzle included in the working liquid nozzle row in the sub-scanning direction (Y-axis direction) is performed based on attribute information of the roll paper 5.

This will be described in detail below.

Figure 5:
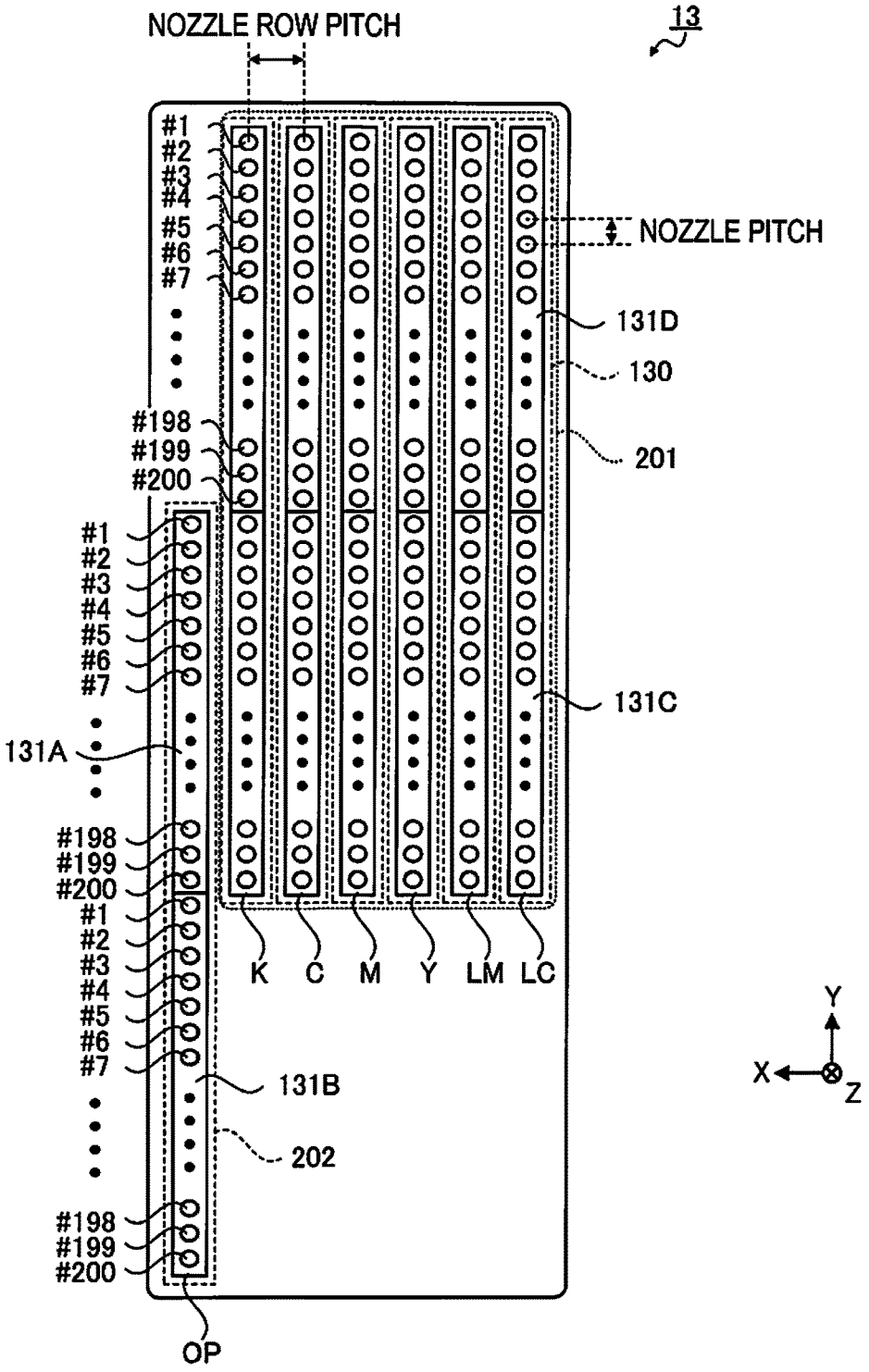
FIG. 5 is a schematic diagram illustrating an example of an arrangement of nozzles in the print head according to Embodiment 1.

FIG. 5 is a schematic diagram illustrating an example of the arrangement of the nozzles in the print head 13 of Embodiment 1. Similarly as in FIG. 4, a state when viewed from the lower surface of the print head 13 is illustrated.

The print head 13 includes the color nozzle row 201 composed of six nozzle rows of the black ink nozzle row K, the cyan ink nozzle row C, the magenta ink nozzle row M, the yellow ink nozzle row Y, the light magenta ink nozzle row LM, and the light cyan ink nozzle row LC 130 as the "first nozzle group" and the working liquid nozzle row 202 (that is, working liquid nozzle row 202 is working liquid nozzle row OP) composed of one working liquid nozzle row OP as the "second nozzle group".

The working liquid nozzle row 202 is provided at a position deviated in the upstream side (Y-axis direction) in the sub-scanning direction (Y-axis direction) by a length corresponding to one nozzle chip 131 with respect to the color nozzle row 201. Except for this point, the print head 13 is the same as the print head 13*c* in the related art.

The control device 110 performs control of the relative position between the use area of the nozzle included in the color nozzle row 201 and the use area of the nozzle included in the working liquid nozzle row 202 in the sub-scanning direction (Y-axis direction), with respect to the printer 100 including the print head 13 having such a configuration, based on the attribute information of the roll paper 5. The working liquid nozzle row 202 is provided at a position deviated in the upstream side (−Y direction) in the sub-scanning direction (Y-axis direction) by the length of one nozzle chip 131 with respect to the color nozzle row 201 to widen a control width of the relative position between the working liquid nozzle row 202 and the color nozzle row 201.

Control contents will be described in detail below.

Attribute information of the roll paper 5 includes information on a permeation speed at which the ink permeates the roll paper 5. For example, with respect to the roll paper 5 ("second print medium" in the invention) having a high permeation speed, the control of the relative position between the use area of the nozzle included in the color nozzle row 201 and the use area of the nozzle included in the working liquid nozzle row 202 in the sub-scanning direction (Y-axis direction) is performed so that the time difference between the timing at which ink is applied by the nozzles included in the color nozzle row 201 and the timing at which the working liquid is applied by the nozzles included in the working liquid nozzle row 202 becomes smaller.

In contrast, with respect to the roll paper 5 ("first print medium" in the invention) having a low permeation speed, the control of the relative position between the use area of the nozzle included in the color nozzle row 201 and the use area of the nozzle included in the working liquid nozzle row 202 in the sub-scanning direction (Y-axis direction) is performed so that the time difference between the timing at which ink is applied by the nozzles included in the color nozzle row 201 and the timing at which the working liquid is applied by the nozzles included in the working liquid nozzle row 202 becomes larger.

Control for Second Print Medium

The roll paper 5 (for example, plain paper or the like) having a relatively high permeation speed of a liquid (working liquid (OP) or color ink) (or permeable) is often preferable to apply color ink in a state where a certain amount of the working liquid (OP) remains on the surface of the roll paper 5. For that reason, the control device 110 performs control so as to apply color ink (before a long period of time passed) just after application of the working liquid (OP).

More specifically, control is performed so that the application of color ink is completed in the same pass operation as the pass operation to which the working liquid (OP) is applied, or at least in the next pass operation. The working liquid (OP) is applied by using the nozzle chip 131A that can eject the working liquid to the same area of the roll paper 5 in the same pass operation as the application of color ink, in the working liquid nozzle row 202 composed of two nozzle chips 131 (nozzle chips 131A and nozzle chips 131B) extending and aligned side by side in the Y-axis direction (see FIG. 5).

Figure 6:
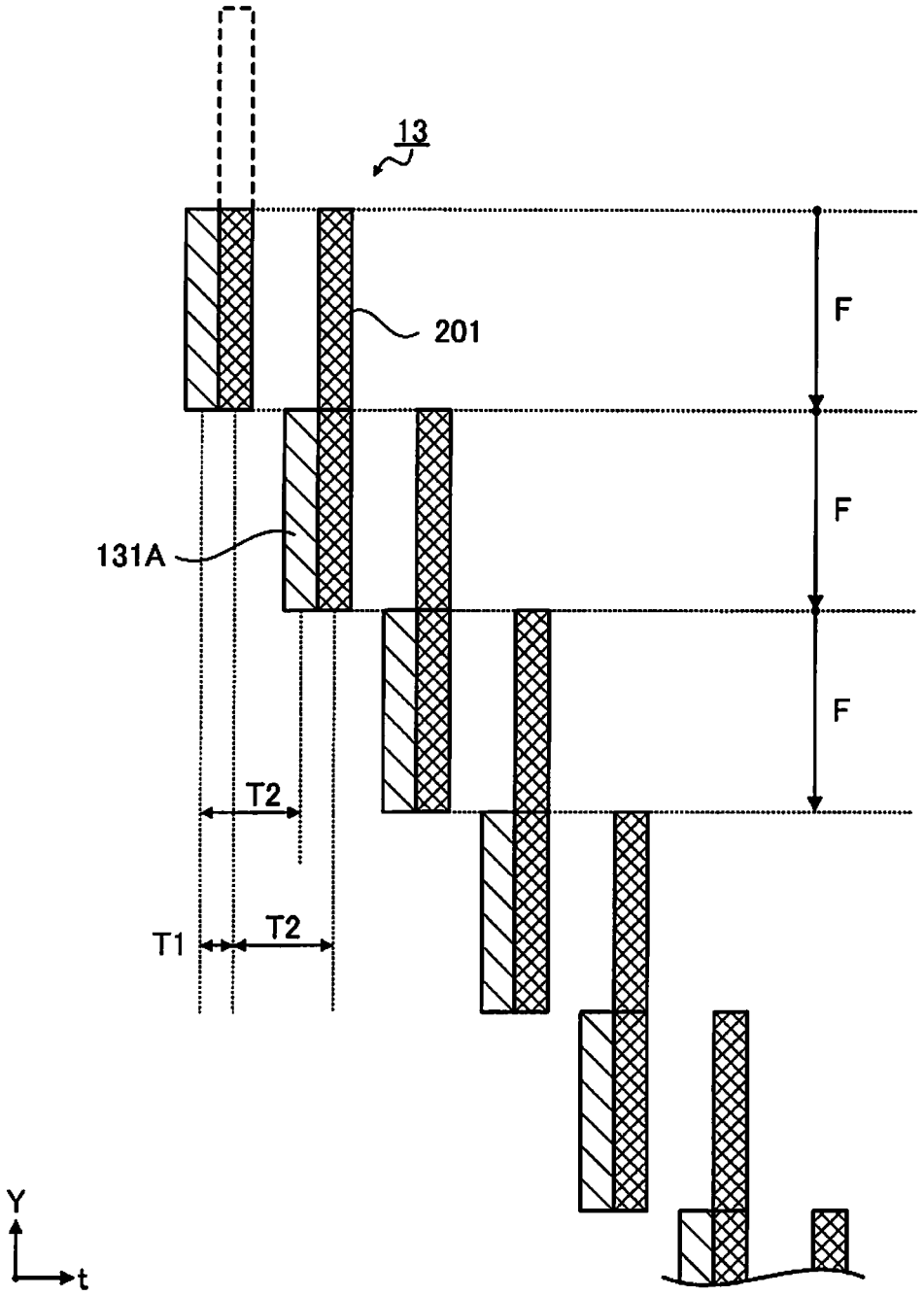
FIG. 6 is an explanatory diagram illustrating an example of printing.

FIG. 6 is an explanatory diagram illustrating an example of printing by this method, and illustrates the relationship between the movement of the roll paper 5 in the transport direction (+Y direction) and the nozzle area used in the pass operation.

In FIG. 6, for ease of understanding, regarding the working liquid nozzle row 202 of the print head 13, only the nozzle chip 131A which is the use area of the nozzle included in the working liquid nozzle row 202 is illustrated and regarding the color nozzle row 201, six nozzle rows 130 are collectively illustrated as one color nozzle row 201. The vertical axis in FIG. 6 is the sub-scanning direction (Y-axis) and the horizontal axis is time (t-axis). F illustrated in FIG. 6 is the feed amount in sub-scanning between the pass operations. That is, in FIG. 6, the print head 13 is depicted as moving in the −Y direction, but actually the roll paper 5 moves in the +Y direction.

In the example illustrated in FIG. 6, the application of the working liquid (OP) to the area is completed by one pass operation and formation of the image by color ink for the same area is completed by two pass operations. Also, in order to simplify explanation, description will be made on a case where the application of the working liquid (OP) and color ink is performed only in the forward path of the reciprocally moving scanning movement and in one pass operation, the working liquid (OP) is applied first and the color ink is applied later.

In the first pass operation, first, the working liquid (OP) is applied by the nozzle chip 131A, and then color ink is applied from the nozzle chip 131C (see FIG. 5) of the color nozzle row 201 adjacent to the nozzle chip 131A in the X-axis direction during the same pass operation (after time T1).

Next, the roll paper 5 is fed and the print head 13 is moved backward, and in the next pass operation, the working liquid (OP) is applied to a new area of the roll paper 5 by the nozzle chip 131A, and then color ink is applied from the nozzle chip 131C of the color nozzle row 201 adjacent the nozzle chip 131A in the X-axis direction during the same pass operation (after time T1). At the same time, color ink is applied (that is, applied after time T1+T2 from the timing at which the working liquid (OP) is applied in the previous pass operation) to the area, where the image is formed in the previous pass operation, from a nozzle chip 131D of the color nozzle row 201 not adjacent to the nozzle chip 131A in the X-axis direction, and the image in that area is completed.

Next, the roll paper 5 is fed, and the print head 13 is moved backward accordingly, and the same operation is repeated thereafter.

As such, by using the nozzle chip 131A capable of applying the working liquid (OP) in the same pass operation as the color nozzle row 201, the application of the color ink is completed by the time T1 later and by the time T1+T2 (that is, image formation) later from the application of the working liquid (OP).

Control for First Print Medium

A roll paper 5 (for example, a resin sheet or a printing paper coated with a resin on its surface) having a low permeation speed of a liquid (working liquid (OP) or color ink) (or not permeated) is often preferable to apply color ink after fixing the working liquid (OP) to the roll paper 5 to some extent. For that reason, the control device 110 performs control so as to apply color ink at a time after applying the working liquid (OP).

More specifically, control is performed so that color ink is applied after the next pass operation different from the pass operation to which the working liquid (OP) is applied. For example, the working liquid (OP) is applied by using the nozzle chip 131B that can eject the working liquid to different areas of the roll paper 5 in the same pass operation as the application of color ink, in the working liquid nozzle row 202 composed of two nozzle chips 131 (nozzle chip 131A and nozzle chip 131B) extending and arranged side by side in the Y-axis direction (see FIG. 5).

Figure 7:
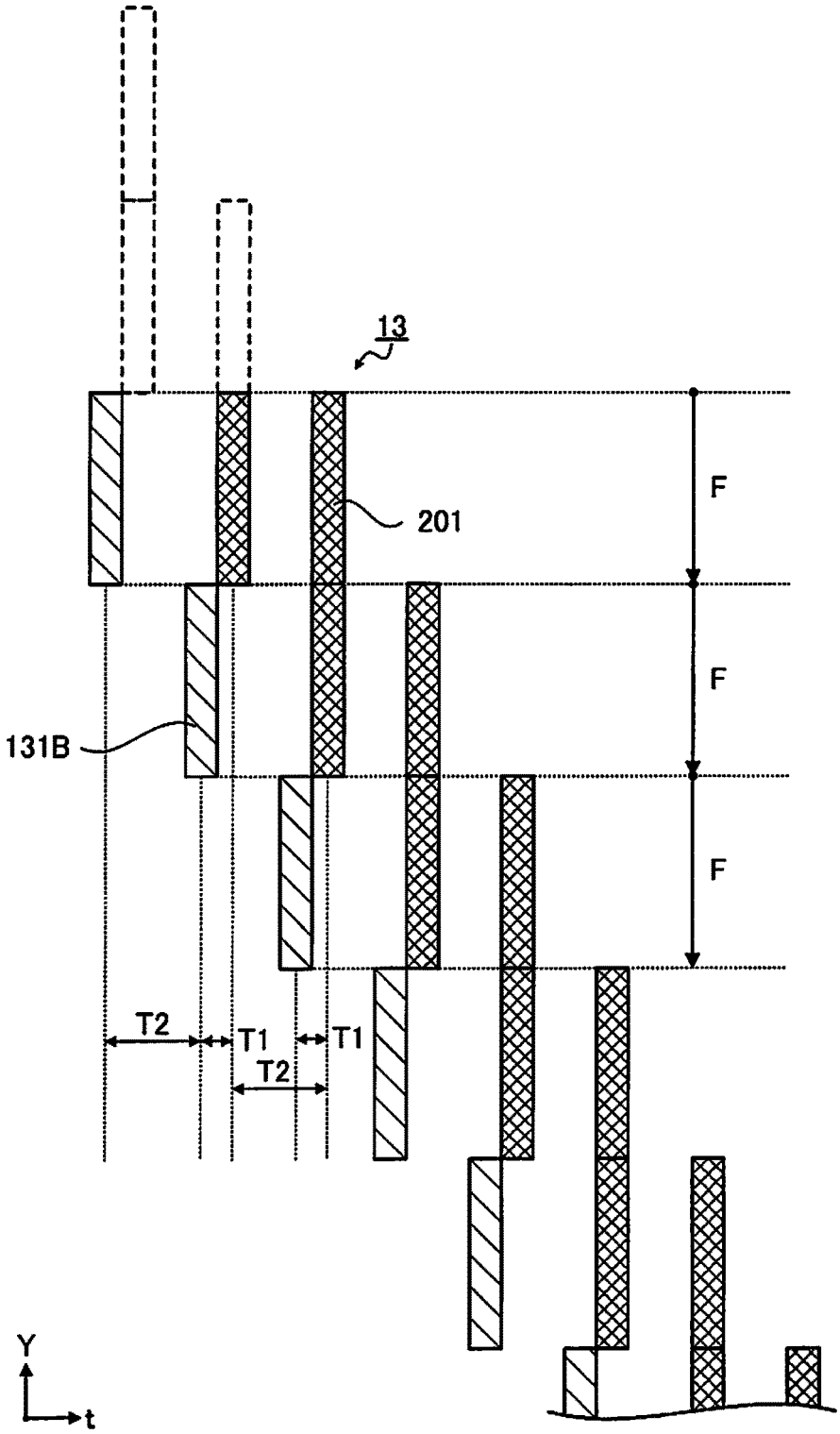
FIG. 7 is an explanatory diagram illustrating another example of printing.

Similar to FIG. 6, FIG. 7 is an explanatory view illustrating an example of printing by this method, and illustrates the relationship between the movement of the roll paper 5 in the transport direction (+Y direction) and the nozzle area to be used in the pass operation.

In the first pass operation, first, the working liquid (OP) is applied by the nozzle chip 131B. At this time, no color ink is applied.

Next, the roll paper 5 is fed and the print head 13 is moved backward accordingly, and in the next pass operation, the working liquid (OP) is applied to a new area of the roll paper 5 by the nozzle chip 131B, and color ink is applied, during the same pass operation (after time T1), from the nozzle chip 131C (see FIG. 5) of the color nozzle row 201 adjacent to the nozzle chip 131A not used later in the X axis direction. At this time, color ink is not applied from the nozzle chip 131D (see FIG. 5) of the color nozzle row 201 which is not adjacent to the nozzle chip 131A in the X-axis direction.

Next, the roll paper 5 is fed and the print head 13 is moved backward accordingly, and in the next pass operation, the working liquid (OP) is applied to a new area of the roll paper 5 by the nozzle chip 131B, and color ink is applied, during the same pass operation (after time T1), from the nozzle chip 131C of the color nozzle row 201 adjacent to the nozzle chip 131A which is not used later in the X-axis direction. At the same time, color ink is applied to the area where the image is formed by the previous pass operation from the nozzle chip 131D of the color nozzle row 201 not adjacent to the nozzle chip 131A in the X-axis direction, and the image in that area is completed.

Next, the roll paper 5 is fed, and the print head 13 is moved backward accordingly, and the same operation is repeated thereafter.

As such, by using the nozzle chip 131B capable of applying the working liquid (OP) to the area of the different roll paper 5 in the same pass operation as the color nozzle row 201, it is possible to apply color ink at least after a lapse of time T1+T2 from application of the working liquid (OP). That is, as compared with the case where the nozzle chip 131A is used for applying the working liquid (OP), it is possible to apply color ink after a lapse of a time T2 from the application of the working liquid (OP), as compared with the case where the nozzle chip 131A is used for applying the working liquid (OP)). Further, since the application of the working liquid (OP) and the application of color ink can be performed simultaneously on different areas of the roll paper 5, the printing speed is not lowered.

In the above description, although the "first print medium" is defined as a roll paper 5 having a low permeation speed (or not permeated) and the "second print medium" is defined as a roll paper 5 having a relatively high permeation speed (or permeable), it is desirable that this classification is performed based on a clear quantitative value (for example, permeation speed of a liquid, and the like) after a sufficient evaluation is made in advance. This is because the relative position and the time difference are not controlled by linearly continuous function values or the like in control of the relative position between the use area of the nozzle included in the color nozzle row 201 and the use area of the nozzle included in the working liquid nozzle row 202 in the sub-scanning direction (Y-axis direction), based on the attribute information of the roll paper 5, that is, control of the time difference between the application timing of the working liquid (OP) and the application timing of color ink.

That is, control of the relative position is performed in such a way that under sufficient evaluation, with respect to the roll paper 5 having the permeation speed lower than the predetermined value, the use area of the nozzle included in the color nozzle row 201 and the use area of the nozzle included in the working liquid nozzle row 202 are used in different pass operations and with respect to the roll paper 5 having the permeation speed equal to or higher than the predetermined value, the use area of the nozzle included in the color nozzle row 201 and the working liquid nozzle row 202 and the use area of the nozzles included in the nozzle group are used in the same pass operation.

Generation of Print Data

Next, generation of print data as an example of a method that can easily perform the control described above (that is, control of the relative position between the use area of the nozzle included in the color nozzle row 201 and the use area of the nozzle included in the working liquid nozzle row 202, based on attribute information of the roll paper 5, in the sub-scanning direction (Y-axis direction), that is, control of the time difference between the application timing of working liquid (OP) and the application timing of color ink) will be described.

In the above description and the following description, the nozzle group of the nozzle chip 131A capable of applying a liquid to the same area in the same pass operation as the color nozzle row 201 is the "A nozzle group" in the invention. The nozzle group of the nozzle chip 131B capable of applying the liquid to different area in the same pass operation as the color nozzle row 201 is the "B nozzle group" in the invention.

In generating print data, with respect to the same area of the image data, the control device 110 generates corresponding halftone data for each of the nozzle group (A nozzle group) of the nozzle chip 131A and the nozzle group (B nozzle group) of the nozzle chip 131B for the same area of image data and selects one of the generated halftone data based on attribute information of the roll paper 5 to generate print data.

Although, in halftone processing of the basic functions of the printer driver described above, an example of a method in which halftone processing is performed for each type of liquid (working liquid (OP) or color ink) to be ejected and the result of the halftone processing is rasterized in the entire nozzle row that ejects the same liquid is described, in halftone processing according to an embodiment, halftone processing is separately performed for each nozzle group even for the same liquid, and the result of the halftone processing is rasterized for each nozzle group. Specifically, halftone processing is performed for each of constituting nozzle chips 131, rasterization processing is performed on the result of the halftone processing for each nozzle chip 131, and print data is generated. That is, print data is generated so that an image is formed over the entire image data for each of the constituting nozzle chips 131.

Figure 8:
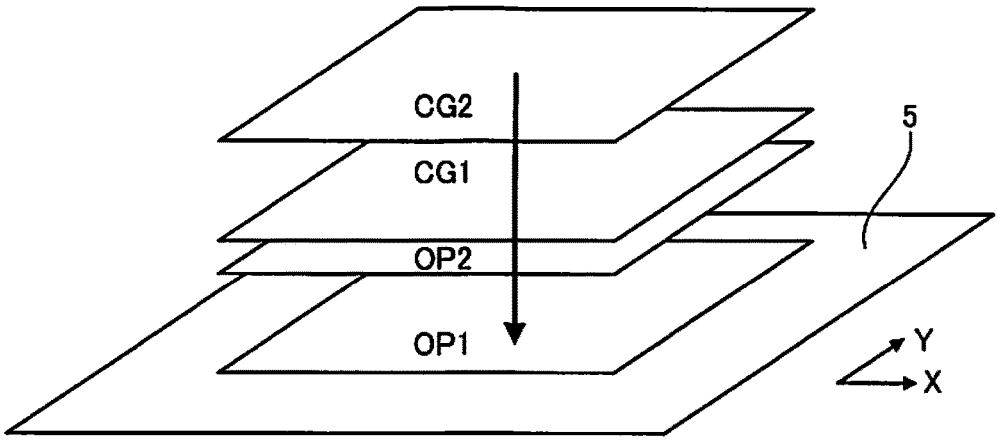
FIG. 8 is a conceptual diagram for explaining a state in which printing corresponding to image data is performed.

FIG. 8 is a conceptual diagram for explaining a state in which printing corresponding to image data is performed by forming and superimposing images for each of the constituting nozzle chips 131.

OP1 illustrated in FIG. 8 is a layer (hereinafter, referred to as layer OP1) of the working liquid (OP) formed by the nozzle group (nozzle group B) of the nozzle chip 131B. OP2 is a layer (hereinafter, referred to as layer OP2) of the working liquid (OP) formed by the nozzle group (nozzle group A) of the nozzle chip 131A. CG1 is a layer (hereinafter, referred to as layer CG1) of color ink formed by the nozzle group of the nozzle chip 131C of the color nozzle row 201 which applies color ink to the same area in the same pass operation as the pass operation forming the layer OP2. CG2 is a layer (hereinafter, referred to as layer CG2) of color ink formed by the nozzle group of the nozzle chip 131D of the color nozzle row 201 which applies color ink to different areas in the same pass operation as the pass operation forming the layer OP2. These layers are sequentially formed on the roll paper 5 by a plurality of pass operations, but the order in which each liquid is applied to form these layers is as illustrated in FIG. 8 (that is, layer OP1, layer OP2, layer CG1, and layer CG2 in this order).

The control device 110 selects one of halftone data corresponding to the nozzle group (A nozzle group) of the nozzle chip 131A and halftone data corresponding to the nozzle group (B nozzle group) of the nozzle chip 131B, based on attribute information of the roll paper 5, and generates print data.

Figure 9:
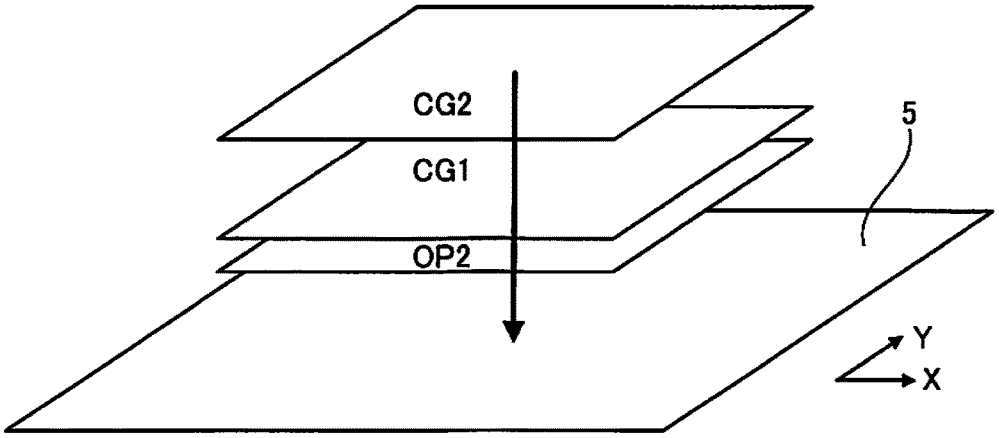
FIG. 9 is a conceptual diagram for explaining another state in which printing corresponding to image data is performed.

For example, as illustrated in FIG. 9, with respect to the roll paper 5 (second print medium) having a relatively high permeation speed of the working liquid (OP) (or permeable), the layer OP2 is adopted and printing without using the layer OP1 is performed. That is, halftone data corresponding to the nozzle group (A nozzle group) of the nozzle chip 131A is selected and printing is performed according to print data generated without using halftone data corresponding to the nozzle group (B nozzle group) of the nozzle chip 131B.

As a result, similarly as in the case described with reference to FIG. 6, by using the nozzle chip 131A capable of applying the working liquid (OP) in the same pass operation as the color nozzle row 201, the application of the color ink is completed by the time T1 later and by the time T1+T2 (that is, image formation) later from the application of the working liquid (OP).

Figure 10:
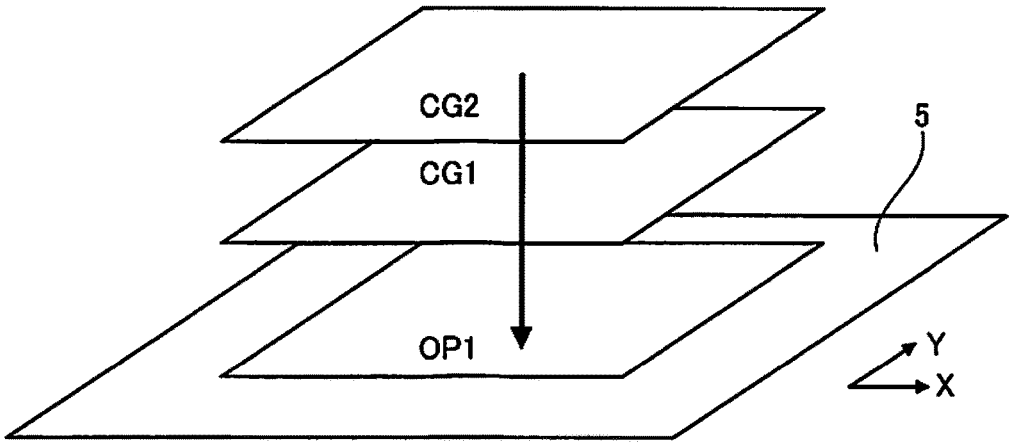
FIG. 10 is a conceptual diagram for explaining another state in which printing corresponding to image data is performed.

For example, as illustrated in FIG. 10, with respect to the roll paper 5 (first print medium) having a low permeation speed of the working liquid (OP) (or not permeated), the layer OP1 is adopted and printing without using the layer OP2 is performed. That is, halftone data corresponding to the nozzle group (B nozzle group) of the nozzle chip 131B is selected and printing is performed according to print data generated without using halftone data corresponding to the nozzle group (A nozzle group) of the nozzle chip 131A.

As a result, similarly as in the case described with reference to FIG. 7, by using the nozzle chip 131B capable of applying the working liquid (OP) to the area of the different roll paper 5 in the same pass operation as the color nozzle row 201, it is possible to apply color ink at least after a lapse of time T1+T2 from the application of the working liquid (OP).

As described above, according to the printing apparatus and the printing method of an embodiment, the following effects can be obtained.

It is possible to perform control of the timing at which ink is applied by the nozzles included in the working liquid nozzle row 202 with respect to the timing at which ink is applied by the nozzles included in the color nozzle row 201, based on attribute information of the roll paper 5.

It is possible to perform control of the timing at which ink is applied by the nozzles included in the working liquid nozzle row 202 with respect to the timing at which ink is applied by the nozzles included in the color nozzle row 201 based on the permeation speed at which the ink permeates the roll paper 5. As a result, it is possible to suppress a difference (reduction) in print quality due to a difference in permeation speed of the ink.

The control of the relative position (relative position between the use area of the nozzle included in the color nozzle row 201 and the use area of the nozzle included in the working liquid nozzle row 202 in the sub-scanning direction (Y-axis direction)) is performed with respect to the roll paper 5 having a higher permeation speed so that the time difference between the timing at which ink is applied by the nozzles included in the color nozzle row 201 and the timing at which ink is applied by the nozzles included in the working liquid nozzle row 202 becomes smaller. For that reason, it is possible to suppress the difference (reduction) in print quality due to the difference in the permeation speed of the liquid.

It is possible to perform control so that the application of ink by the nozzle included in the color nozzle row 201 and the application of ink by the nozzle included in the working liquid nozzle row 202 are performed in different pass operations with respect to the roll paper 5 having the permeation speed lower than the predetermined value and the application of ink by the nozzle included in the color nozzle row 201 and the application of ink by the nozzle included in the working liquid nozzle row 202 are performed in the same pass operation with respect to the roll paper 5 having the permeation speed equal to or higher than the predetermined value. For that reason, it is possible to suppress a difference (reduction) in print quality due to a difference in permeation speed of the ink.

In generating print data, the control device 110 generates halftone data for determining a formation state of dots to be formed by applying ink, in each of the A nozzle group and the B nozzle group with respect to the same area of image data, selects one of the generated halftone data based on attribute information of the roll paper 5, and generates print data so as to make it possible to easily perform the control (that is, control of the relative position between the use area of the nozzle included in the color nozzle row 201 and the use area of the nozzle included in the working liquid nozzle row 202, based on attribute information of the roll paper 5, in the sub-scanning direction (Y-axis direction), that is, control of the time difference between the application timing of working liquid (OP) and the application timing of color ink) described above. As a result, in the time difference between the timing at which ink is applied by the nozzles included in the color nozzle row 201 and the timing at which ink is applied by the nozzles included in the working liquid nozzle row 202, it is possible to select a printing method having a more appropriate time difference by being associated with attribute information of the roll paper 5.

According to the printing method of an embodiment, it is possible to more appropriately perform control of the timing at which ink is applied by the nozzles included in the working liquid nozzle row 202 with respect to the timing at which ink is applied by the nozzles included in the color nozzle row 201, based on attribute information of the roll paper 5.

Although matters that attribute information on the roll paper 5 includes information on the permeation speed at which the ink permeates the roll paper 5 is described, information pertaining directly to the permeation speed may not necessarily be included as attribute information on the roll paper 5 as long as the attribute information is information by which the material, the configuration, and the like of the roll paper 5 can be identified. For example, it may be information such as a product model number of the roll paper 5, a material name constituting the roll paper 5, a constitution specification of the material, and the like may be included. However, in order to derive the necessary control specification in advance, it is desirable to make a thorough evaluation for each product model number and configuration specification.

The invention is not limited to the embodiment described above, and various modifications and improvements can be added to the embodiment described above. Modification examples will be described below. Here, the same reference numerals are used for the same constitution portion as those in the embodiment described above, and redundant description thereof is omitted.

Modification Example 1

In Embodiment 1, as an example of control performed by the control device 110, as illustrated in FIGS. 9 and 10, matters that in generating print data, corresponding halftone data is generated for each of the nozzle group (A nozzle group) of the nozzle chip 131A and the nozzle group (B nozzle group) of the nozzle chip 131B for the same area of image data and one of the generated halftone data based on attribute information of the roll paper 5 is selected, and print data is generated are described. That is, in applying the working liquid (OP), matters that one of the layer OP1 and the layer OP2 is selected as the layer of the working liquid (OP) based on attribute information of the roll paper 5 are described. However, a method in which both of these layers are selected in some cases may be adopted. That is, a method in which, in generating print data, both corresponding nozzle halftone data may be reflected on print data in some cases in each of the nozzle group (A nozzle group) of the nozzle chip 131A and the nozzle group (B nozzle group) of the nozzle chip 131B, based on attribute information of the roll paper 5 may be adopted.

For example, both the layer OP1 and the layer OP2 are selected as the layer of the working liquid (OP) for the roll paper 5 (second print medium) having a high permeation speed based on attribute information of the roll paper 5 and control to increase the application amount of the working liquid (OP) to be applied earlier than the color ink is performed so that it is possible to allow a necessary and sufficient amount of the working liquid (OP) to remain on the surface of the roll paper 5. As a result, it is possible to more easily suppress the difference (reduction) in print quality due to the difference in permeation speed of the ink.

Modification Example 2

Figure 11:
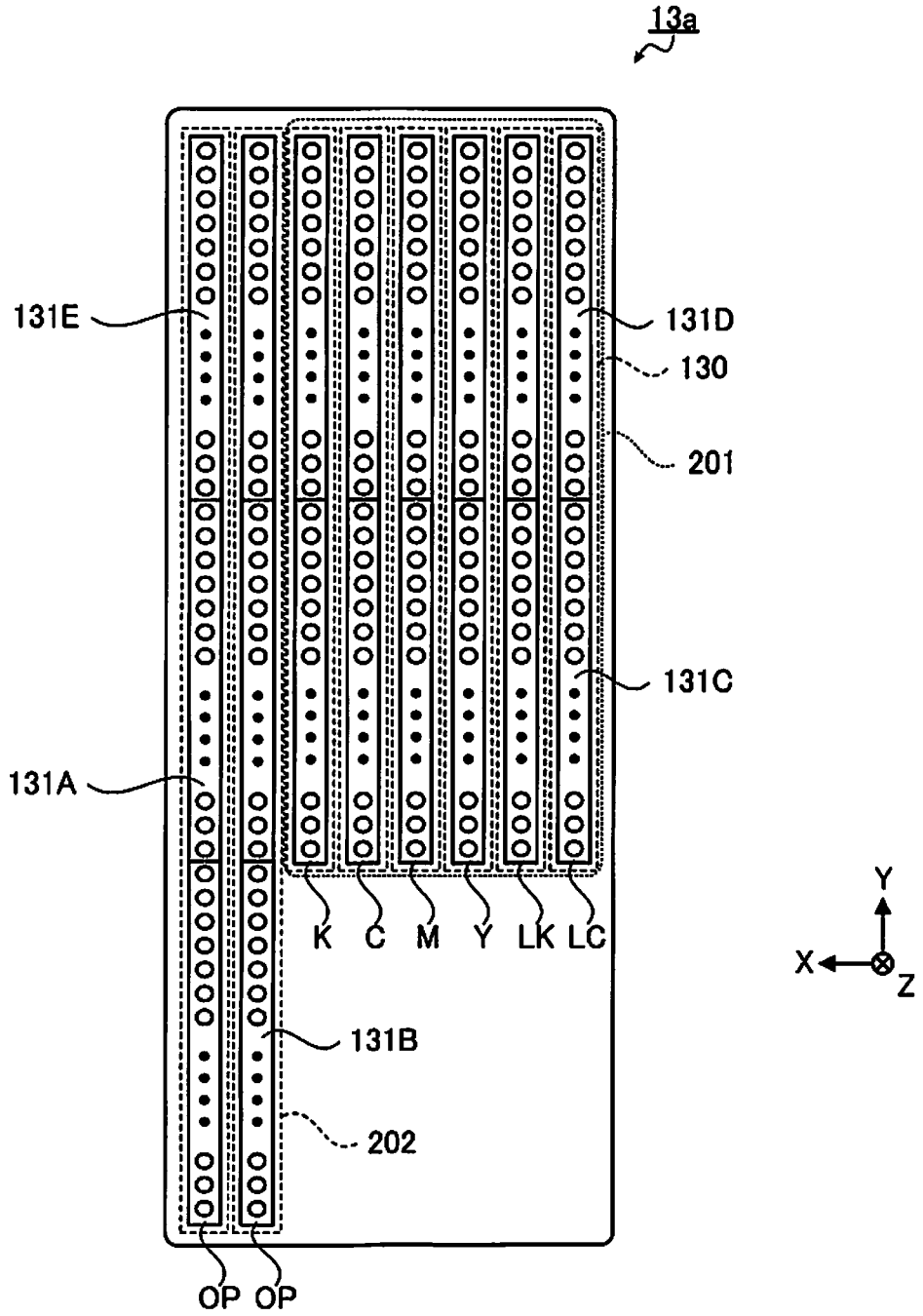
FIG. 11 is a schematic diagram illustrating an example of a configuration of a print head according to Modification Example 2.

FIG. 11 is a schematic diagram illustrating an example of the configuration of the print head 13*a* according to Modification Example 2.

In Embodiment 1, as illustrated in FIG. 5, in the print head 13, the working liquid nozzle row 202 is provided at a position deviated in the upstream side (−Y direction) in the sub-scanning direction (Y-axis direction) by a length corresponding to one nozzle chip 131 with respect to the color nozzle row 201, but the invention is not limited to the configuration described above. For example, as illustrated in FIG. 11, the working liquid nozzle row 202 may be configured to be longer than the color nozzle row 201 by the length of one nozzle chip 131 in the upstream side (−Y direction) in the sub-scanning direction (Y-axis direction). That is, as illustrated in FIG. 11, the working liquid nozzle row 202 has a configuration in which one nozzle chip 131E is added to the +Y side with respect to the print head 13 of Embodiment 1. In the print head 13 of Embodiment 1, the working liquid nozzle rows 202 are arranged in one row, but a configuration of the print head in which two rows of working liquid nozzle rows 202 are arranged is adopted in Modification Example 2.

According to such a configuration, it is possible to perform printing similar to printing using the print head 13*c* (see FIG. 4) in the related art, and it is also possible to obtain the effect by the control of the embodiment described above.

Further, two rows of the working liquid nozzle rows 202 are provided and accordingly, for example, in a case where each of two rows of the working liquid nozzle rows 202 ejects the same working liquid (OP), it becomes possible to control the amount of the working liquid (OP) to be applied to the roll paper 5 with a wider width. For example, the control device 110 can double the amount of the working liquid (OP) to be applied before the color ink. As a result, even for the roll paper 5 (second print medium) having a high permeation speed, it is possible to allow a necessary and sufficient amount of the working liquid (OP) to remain on the surface of the roll paper 5 by applying a sufficient amount of the working liquid (OP), at the timing when the color ink is applied. That is, in the printing system 1 using the print head 13*a* according to Modification example 2, for the roll paper 5 (second print medium) having a high permeation speed, it is possible to perform control to increase an application amount of the working liquid (OP) to be applied earlier than color ink, based on attribute information of the roll paper 5. As a result, it is possible to more easily suppress the difference (reduction) in print quality due to the difference in permeation speed of the ink.

The configuration for increasing the application amount of the working liquid (OP) is not limited to the method of increasing the number of rows of the working liquid nozzle row 202 as described above. For example, a method of increasing the amount of droplets per shot by changing the configuration of the nozzles included in the working liquid nozzle row 202 may be adopted.

In Modification example 2, for example, in a case where two working liquid nozzle rows 202 eject different working liquids (OP), respectively, working liquids (OP) having different actions can be independently applied as needed. Based on attribute information of the roll paper 5, appropriate control (control of the relative position between the use area of the nozzle included in the color nozzle row 201 and the use area of the nozzle included in each working liquid nozzle row 202 in the sub-scanning direction (Y-axis direction), that is, control of the time difference between the application timing of each working liquid (OP) and the application timing of color ink) can be performed for each working liquid (OP) to be used.

Modification Example 3

Figure 12:
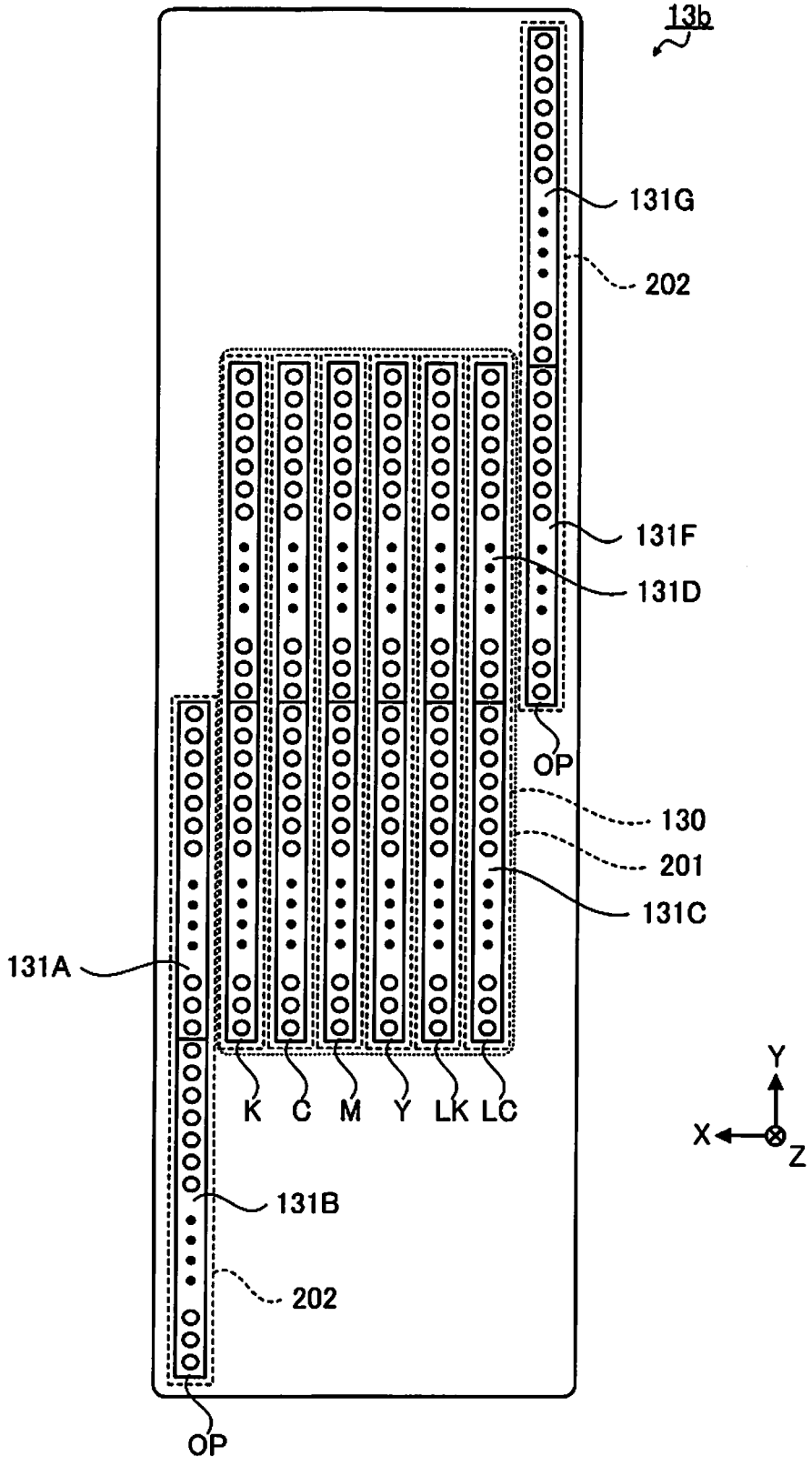
FIG. 12 is a schematic diagram illustrating an example of a configuration of a print head according to Modification Example 3.

FIG. 12 is a schematic diagram illustrating an example of a configuration of a print head 13*b* according to Modification example 3.

In Embodiment 1, as illustrated in FIG. 5, in the print head 13, the working liquid nozzle row 202 is provided at a position deviated in the upstream side (−Y direction) in the sub-scanning direction (Y-axis direction) by a length corresponding to one nozzle chip 131 with respect to the color nozzle row 201, but the invention is not limited to the configuration described above. For example, like the print head 13*b* illustrated in FIG. 12, a configuration in which another working liquid nozzle row 202 (nozzle row composed of nozzle chip 131F and nozzle chip 131G) is provided at a position deviated in the downstream side (+Y direction) in the sub-scanning direction (Y-axis direction) by a length corresponding to one nozzle chip 131 in the −X side of the color nozzle row 201) in the opposite side in point symmetry of the working liquid nozzle row 202 may be adopted.

According to this configuration, in the case where a post-processing liquid (for example, clear ink to be applied so as to cover the color ink and a protective ink for improving the abrasion resistance of the color ink) is applied as the working liquid (OP) after color ink is applied to the roll paper 5 or the like, it is possible to more appropriately control the time difference between the timing when applying the color ink and the timing when applying the working liquid (OP) (post-processing liquid)

Modification Example 4

In Embodiment 1, as one example of control performed by the control device 110, matters that control of the timing at which the liquid is applied by the nozzles included in the second nozzle group with respect to the timing at which the liquid is applied by the nozzles included in the first nozzle group is performed, based on the permeation speed at which the liquid permeates the print medium, are described. However, the timing may be controlled according to a medium name of the print medium. That is, the medium name of the print medium is included as the attribute information of the roll paper 5, and control may be performed, according to the medium name, in either one of a first mode in which a use area of nozzles included in the first nozzle group and a use area of nozzles included in the second nozzle group are used in different pass operations and a second mode in which the use area of nozzles included in the first nozzle group and the use area of the nozzles included in the second nozzle group are used in the same pass operation.

According to this configuration, the medium name of the print medium is selected so as to make it possible to control the relative position of the use area of the appropriate nozzle.

In the embodiment and modification examples described above, an example in which control of the relative position between the use area of the nozzle included in the color nozzle row and the use area of the nozzle included in the working liquid nozzle row 202 201 in the sub-scanning direction (Y-axis direction) is performed by using the nozzle chip 131 as a unit of an area is described, but the invention is not limited thereto.

For example, the control may be performed in such a way that the nozzle group of the nozzle chip 131 is divided into a plurality of small nozzle groups which are continuously aligned and selecting whether to use or not to use for each small nozzle group is performed.

This application claims priority under 35 U.S.C. § 119 to Japanese Patent Application No. 2017-084208, filed Apr. 21, 2017. The entire disclosure of Japanese Patent Application No. 2017-084208 is hereby incorporated herein by reference.

What is claimed is:

1. A printing apparatus comprising:

a print head that has a first nozzle group that applies a liquid to a print medium and a second nozzle group that applies a working liquid to the print medium;

a main scanning unit that relatively moves the print head with respect to the print medium in a main scanning direction;

a sub-scanning unit that relatively moves the print medium with respect to the print head in a sub-scanning direction intersecting the main scanning direction; and a control unit that controls the print head, the main scanning unit, and the sub-scanning unit, based on attribute information of the print medium, in one of a first mode and a second mode, the attribute information including one of a medium name of the print medium, information on permeation speed at which the liquid and the working liquid permeate the print medium, and information indicating material and configuration of the print medium, wherein in the first mode, a use area in which nozzles that are included in the first nozzle group and apply the liquid are arranged and a use area in which nozzles that are included in the second nozzle group and apply the working liquid are arranged do not overlap each other as viewed in the main scanning direction, and in the second mode, a use area in which nozzles that are included in the first nozzle group and apply the liquid are arranged and a use area in which nozzles that are included in the second nozzle group and apply the working liquid are arranged at least partially overlap each other as viewed in the main scanning direction.

2. The printing apparatus according to claim 1, wherein the attribute information includes the medium name of the print medium.

3. The printing apparatus according to claim 2, wherein, in one pass operation of applying the liquid and the working liquid to the print medium while relatively moving the print head with respect to the print medium in the main scanning direction, the control unit controls the print head to apply the liquid and the working liquid, in either one of the first mode and the second mode according to the medium name.

4. The printing apparatus according to claim 1, wherein the attribute information includes the information on the permeation speed.

5. The printing apparatus according to claim 4, wherein the control unit controls the print head to apply the liquid and the working liquid to a first print medium in the first mode, and the control unit controls the print head to apply the liquid and the working liquid to a second medium having the permeation speed higher than that of the first print medium in the second mode.

6. The printing apparatus according to claim 4, wherein, in one pass operation in which the liquid and the working liquid are applied to the print medium while relatively moving the print head with respect to the print medium in the main scanning direction, the control unit controls the print head to apply the liquid and the working liquid to the print medium in which the permeation speed is lower than a predetermined value in the first mode, and the control unit controls the print head to apply the liquid and the working liquid to the print medium in which the permeation speed is equal to or greater than the predetermined value in the second mode.

7. The printing apparatus according to claim 4, wherein the control unit makes an application amount of liquid to be applied first, among the liquid to be applied from the nozzles included in the first nozzle group and the working liquid to be applied from the nozzles included in the second nozzle group, with respect to a second print medium having the permeation speed higher than a first print medium larger than the application amount with respect to the first print medium.

8. The printing apparatus according to claim 1, wherein the second nozzle group includes an A nozzle group configured to apply the working liquid to the same area in the pass operation which is the same as that of the first nozzle group and a B nozzle group configured to apply the working liquid to different areas in the pass operation which is the same as that of the first nozzle group, in a pass operation of applying the liquid and the working liquid to the print medium while relatively moving with respect to the print medium in the main scanning direction, and the control unit generates halftone data which is for determining a formation state of dots to be formed, with respect to the same area of image data, by applying the working liquid in each of the A nozzle group and the B nozzle group, in generating print data which is for performing control the relative position and is for executing printing based on the image data, selects one of the generated halftone data based on the attribute information of the print medium, and generates the print data.

9. A printing method which is performed in a printing apparatus including a print head that has a first nozzle group that applies a liquid to a print medium and a second nozzle group that applies a working liquid to the print medium, a main scanning unit that relatively moves the print head with respect to the print medium in a main scanning direction, and a sub-scanning unit that relatively moves the print medium in a sub-scanning direction intersecting the main scanning direction with respect to the print head, the printing method comprising:

performing control of the print head, the main scanning unit, and the sub-scanning unit, based on attribute information of the print medium, in one of a first mode and a second mode, the attribute information including one of a medium name of the print medium, information on permeation speed at which the liquid and the working liquid permeate the print medium, and information indicating material and configuration of the print medium, wherein in the first mode, a use area in which nozzles that are included in the first nozzle group and apply the liquid are arranged and a use area in which nozzles that are included in the second nozzle group and apply the working liquid are arranged do not overlap each other as viewed in the main scanning direction, and in the second mode, a use area in which nozzles that are included in the first nozzle group and apply the liquid are arranged and a use area in which nozzles that are included in the second nozzle group and apply the working liquid are arranged at least partially overlap each other as viewed in the main scanning direction.

* * * * *